US006918279B2

(12) United States Patent
Wille

(10) Patent No.: US 6,918,279 B2
(45) Date of Patent: Jul. 19, 2005

(54) BLIND RIVETING DEVICE

(75) Inventor: Lothar Wille, Mörfelden-Walldorf (DE)

(73) Assignee: GESIPA Blindniettechnik GmbH, Frankfurt (DE)

( * ) Notice: Subject to any disclaimer, the term of this patent is extended or adjusted under 35 U.S.C. 154(b) by 0 days.

(21) Appl. No.: 10/093,139

(22) Filed: Mar. 6, 2002

(65) Prior Publication Data

US 2002/0125292 A1 Sep. 12, 2002

(30) Foreign Application Priority Data

Mar. 12, 2001 (DE) ..... 101 11 983
Apr. 3, 2001 (DE) ..... 101 16 525

(51) Int. Cl.[7] ..... B21J 15/22
(52) U.S. Cl. ..... 72/391.4; 29/243.523; 29/243.525
(58) Field of Search ..... 72/391.4, 391.6; 29/243.523, 243.524, 243.525

(56) References Cited

U.S. PATENT DOCUMENTS 3,174,323 A 3/1965 Over
4,887,450 A * 12/1989 Gast et al. ..... 29/243.523
5,490,311 A * 2/1996 Rosier ..... 29/243.523
6,276,037 B1 * 8/2001 Solfronk ..... 29/243.525

FOREIGN PATENT DOCUMENTS

| | | |
|---|---|---|
| DE | 199 52 573 A1 | 5/2000 |
| DE | 200 11 344 U1 | 10/2000 |
| DE | 201 04 373 U1 | 7/2001 |
| EP | 1013358 | 6/2000 |
| FR | 1293331 | 6/1961 |

* cited by examiner

*Primary Examiner*—David Jones
(74) *Attorney, Agent, or Firm*—Friedrich Kueffner

(57) ABSTRACT

A blind riveting device for placing blind rivets includes a device head, wherein an opening for receiving a rivet bolt and a suction device for producing a negative pressure for holding the rivet bolt in the opening are arranged in the head. A control unit for switching the suction device on and off by an actuating element is provided at a handle which is connected to the head. For facilitating the manipulation of the blind riveting device, the actuating element can be locked in a switched-on position.

20 Claims, 3 Drawing Sheets

BLIND RIVETING DEVICE

BACKGROUND OF THE INVENTION

1. Field of the Invention

The present invention relates to a blind riveting device for placing blind rivets, the blind riveting device including a device head, wherein an opening for receiving a rivet bolt and a suction device for producing a negative pressure which holds the rivet bolt in the opening are arranged in the head, and a control unit for switching the suction device on and off by means of an actuating element at a handle which is connected to the head.

2. Description of the Related Art

A blind riveting device of this type is disclosed in EP 1 013 358 A2. In this known blind riveting device, a control bolt is arranged at the handle, wherein the control bolt can be pressed in by means of the middle finger in order to activate the suction device. A lever may additionally be arranged at the control bolt, such that the suction device can be actuated with the lower three fingers of a hand, i.e., the middle finger, the ring finger and the little finger, when the blind riveting device is picked up for placing rivets. When the suction device has been actuated, the negative pressure holds a rivet bolt of a blind rivet which has been inserted into the mouth piece of the blind riveting device, so that the blind rivet does not fall out, even when the blind riveting device is directed downwardly. When the handle of the blind riveting device is released, the suction device is once again switched off, so that an unnecessary consumption of air can be avoided.

However, this known blind riveting device has the disadvantage that the work cannot always be performed with the required safety and reliability during longer use. The compressed air required for producing the negative pressure is only switched on when the blind riveting device is picked up. However, holding the blind riveting device always in a hand in the required position in such a way that the suction device is switched on or remains activated is relatively cumbersome and requires continuous concentration. It is absolutely required for a problem-free operation of the blind riveting device that always at least one finger presses the control bolt or the lever mounted on the control bolt. This results in a compulsory holding position of the fingers at the handle of the blind riveting device which does not make it possible to work without fatigue and which may frequently result in problems of the operation of the blind riveting device when the handle is held in an unconcentrated manner. The resulting problems are either that the blind rivet drops out during the riveting procedures when the mouth piece is directed downwardly, or that the residual bolt is not suctioned away after the riveting procedure has been concluded. Since a blind riveting device of this type is usually used for assembly operations in which two or more components are to be riveted together, the operator must align the components relative to each other in such a way that the bores which are intended for receiving the blind rivets coincide. During such a manipulation of the components there is the danger that the operator changes his holding position of the handle in such a way that the suction device is no longer active and is inadvertently inoperative. In that case, a blind rivet inserted into the opening of the mouthpiece may drop out. This makes it not only necessary to reinsert a new blind rivet, but the blind rivet which has dropped out may lead to a substantial interruption of the further assembly operation. If the residual bolt is not suctioned away into the collecting container after riveting, the rivet drops out toward the front, which leads to an interruption of the work rhythm or may result in clogging within the duct for the removal of the residual bolt.

SUMMARY OF THE INVENTION

Therefore, it is the primary object of the present invention to provide a blind riveting device which can be handled more comfortably by the user.

In accordance with the present invention, in a blind riveting device of the above-described type, the actuating element for the suction device can be locked in a switched-on position.

The configuration according to the present invention makes it possible that the suction device can be activated when the blind riveting device is picked up or grasped. In this respect, the comfort of operating the device is the same as in the conventional device. However, after the suction device has been activated, the operator no longer has to make sure that he holds certain switches, push buttons or levers with a certain force or alignment in his hand in order to maintain the activation of the suction device. Rather, once the suction device has been activated it remains switched on until it is switched off again as a result of an intentional act of the operator. Accordingly, the operation is also functionally safer. Since the actuating element is arranged at the handle, the operator is provided with a reminder, so that when he intentionally releases the blind riveting device he will usually remember to deactivate the suction device. Accordingly, the fact that the actuating element can be switched into the switched-on position does not result in a significantly increased loss of air.

In accordance with a preferred further development, it is provided that the actuating element is constructed as a slide. A slide can be moved approximately parallel to the surface of the handle. Consequently, the slide only protrudes by a small a distance from the surface of the handle. As a result, when the operator picks up the blind riveting device, the manner in which he feels the grip is not impaired in spite of the presence of the actuating element. When the operator does not want to actuate the actuating element, he is not forced to do so. Accordingly, the slide can remain in its switched-off position, if the operator does not consider it necessary to activate the suction device.

In accordance with another preferred feature, the control unit includes a valve push rod which engages in the switched-off position in a recess on the inner side of the slide. Accordingly, the slide is locked without any additional structural components. The holding force is applied by the supplied compressed air which acts on the valve push rod. This provides the additional advantage that locking is concluded when the compressed air is switched off, for example, at the end of an assembly operation. When beginning an operation, the operator can always expect a defined state.

In accordance with a particularly advantageous further development, the slide is moveable upwardly toward the direction of the head for switching on the suction device. The actual placement mechanism for placing the blind rivets, i.e., the device head, is usually arranged at the "top", while a possibly provided pneumatic-hydraulic drive component is usually arranged at the lower part. Accordingly, when picking up the blind riveting device, the operator must intentionally move the slide upwardly in order to activate the suction device, or the operator can activate the suction device by only loosely grasping and lifting the blind riveting device when picking up the device. This loose grasping of the device makes it possible for the operator to intentionally allow the blind riveting device to slide through his hand when lifting the device, and thereby to move the slide on which the middle finger rests up to into the lockable switched-on position by utilizing the weight of the blind riveting device. However, for switching-off the suction device, an intentional act is always required, i.e., the operator must push the slide back into its switched-off position when the device is to be switched off. Sliding of the blind riveting device through the hand and the resulting activation of the suction device can be prevented when the operator firmly grasps the blind riveting device when he picks it up.

In accordance with another preferred feature, the slide has a protrusion at its end located in the switched-on direction. This facilitates manipulation by the hand of the operator. The protrusion serves as an abutment for a finger of the hand. Consequently, if the blind riveting device slides downwardly in the hand of the operator to some extent as a result of its weight under the effect of gravity, the protrusion comes into contact with a finger of the hand, for example, the middle finger, so that the slide is moved relative to the blind riveting device In accordance with another particularly preferred feature, the protrusion is received in the switched-on position in a recess which is provided in a protruding portion of the housing which is arranged underneath a release element. The release element has the purpose of releasing the actual blind riveting procedure, i.e., a pulling process during which a pulling mechanism pulls at the blind rivet in order to place the blind rivet. Consequently, the slide is located underneath this release element. When the slide has been pushed into its switched-on position, the protrusion of the slide disappears in the protruding portion of the housing, so that there are no annoying edges or corners.

The slide preferably protrudes from the handle. This facilitates actuation. The operator can then more easily grasp the slide. However, it is possible that the slide only protrudes by a small distance from the handle, so that the handle essentially has the same gripping behavior as a handle without a slide. Moreover, in this embodiment, the operator always is provided with a small hint that the suction device is to be switched off after the conclusion of the rivet placing procedure. This hint could only be provided with additional means if the slide were completely integrated in the handle.

In accordance with another advantageous feature, the slide has a recessed grip. The recessed grip makes it possible that the finger of the hand of the operator which grasps the blind riveting device can carry out an actuation in one direction, i.e., for switching on or activating the suction device, and also in the other direction, i.e., for switching off the suction device. In both cases, only a small movement of the hand of the operator relative to the blind riveting device is required. Moreover, the selected shape of the slide provides a better adjustment of the handle to the shape of the human hand. This increases the comfort when working with the blind riveting device.

The slide preferably has a length in the range of 1.5 to 3 cm. This length ensures that the slide is only actuated by one finger, preferably the middle finger. This keeps the danger of an incorrect actuation low. The ring finger and the little finger of the hand which grasps the blind riveting device are exclusively used for holding the grip of the blind riveting device. These two fingers are not used for activating the suction device.

The slide preferably has an end directed toward the switched-off direction which forms an overlapped portion with the handle. When the slide is pushed into the switched-on position, there is no gap between the handle and the slide, so that the hand of the operator cannot be pinched when the slide is moved back into its switched-off position.

The slide preferably has an active surface for actuating the valve push rod during displacement. The active surface may be constructed as an inclined surface or as an arched or curved surface. This is a particularly simple manner of transferring the movement of the slide to a valve push rod which moves in a different direction, preferably at a right angle. When the slide is pushed into the switched-on position, the active surface, for example, the inclined surface, pushes the valve push rod into the handle and thereby opens a duct for the compressed air extending from a supply connection to the suction device. Once the slide has reached its switched-on position, the valve push rod, which is permanently pressed by the compressed air with a constant pressure in the direction toward the slide, engages in a recess which is located on the contact surface between the slide and the valve push rod. This locks the slide with a defined force in its switched-on position and, even when the device or the slide are released, the slide cannot be displaced by itself and switch off the suction device.

In accordance with a preferred further development, the slide is arranged at the front side of the handle and can be actuated by the middle finger of an operator. The index finger is usually used for pressing an actuating button for releasing a placement procedure, i.e., the index finger is used for actuating the release element. The middle finger is actually free, i.e., it is available for displacing the slide.

It is also advantageous if the slide is arranged on the backside of the handle and can be actuated by the ball of a thumb or a saddle between the thumb and index finger of a hand. The device is not limited to an actuation on the front side.

In accordance with an advantageous feature, a control element is provided for interrupting the air supply to the suction device. The suction device is only required if riveting is carried out at an inclined angle or vertically downwardly and the suction device has to prevent with its vacuum effect that the blind rivet drops out of the blind riveting device. The above-described suction device is not required for suctioning away the torn off rivet bolts. Accordingly, when riveting is carried out in the horizontal direction or overhead, the suction device can be switched off completely, so that significant amounts of air can be saved. This is carried out by closing the air duct for the suction device by means of an additional control element. In that case, the slide, which usually is used for switching on and off the suction device, can remain in the locked switched-on position and air cannot flow into the suction device.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
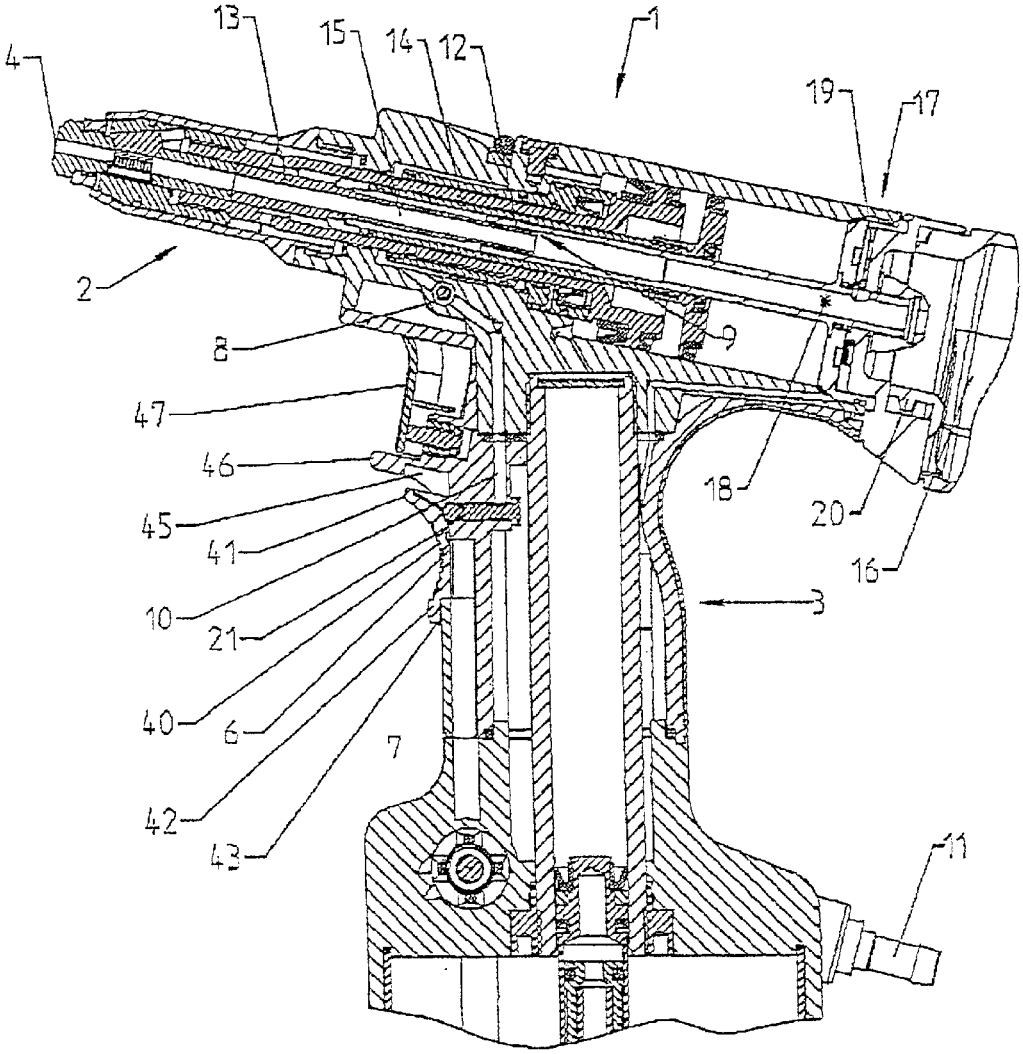
FIG. 1 is a schematic sectional view of a blind riveting device according to the present invention, wherein the suction device is not activated.

FIG. 1 of the drawing shows a blind riveting device 1 which in its upper portion has a device head 2, wherein a handle 3 is connected to the bottom of the head 2. The head 2 has an opening 4 at its front end. The head 2 further has a passage duct 12 which extends from the opening 4 at the front end of the head 2 to the rearward end. Connected to the rearward end of the head 2 is a collecting container 16 (only schematically illustrated) through a bayonet-type connection 20 to the head 2.

The duct 15 is partially defined by a pressure pipe 13. Together with a nozzle pipe 14, the pressure pipe 13 forms a nozzle 12 at the rearward end of the pressure pipe 13. This nozzle 12 forms a suction device 9 which makes it possible to hold a blind rivet whose rivet bolt has been inserted through the opening 4 into the head 2 even if the blind riveting device 1 is held in such a way that its opening 4 is pointed downwardly in the direction of gravity.

Figure 2:
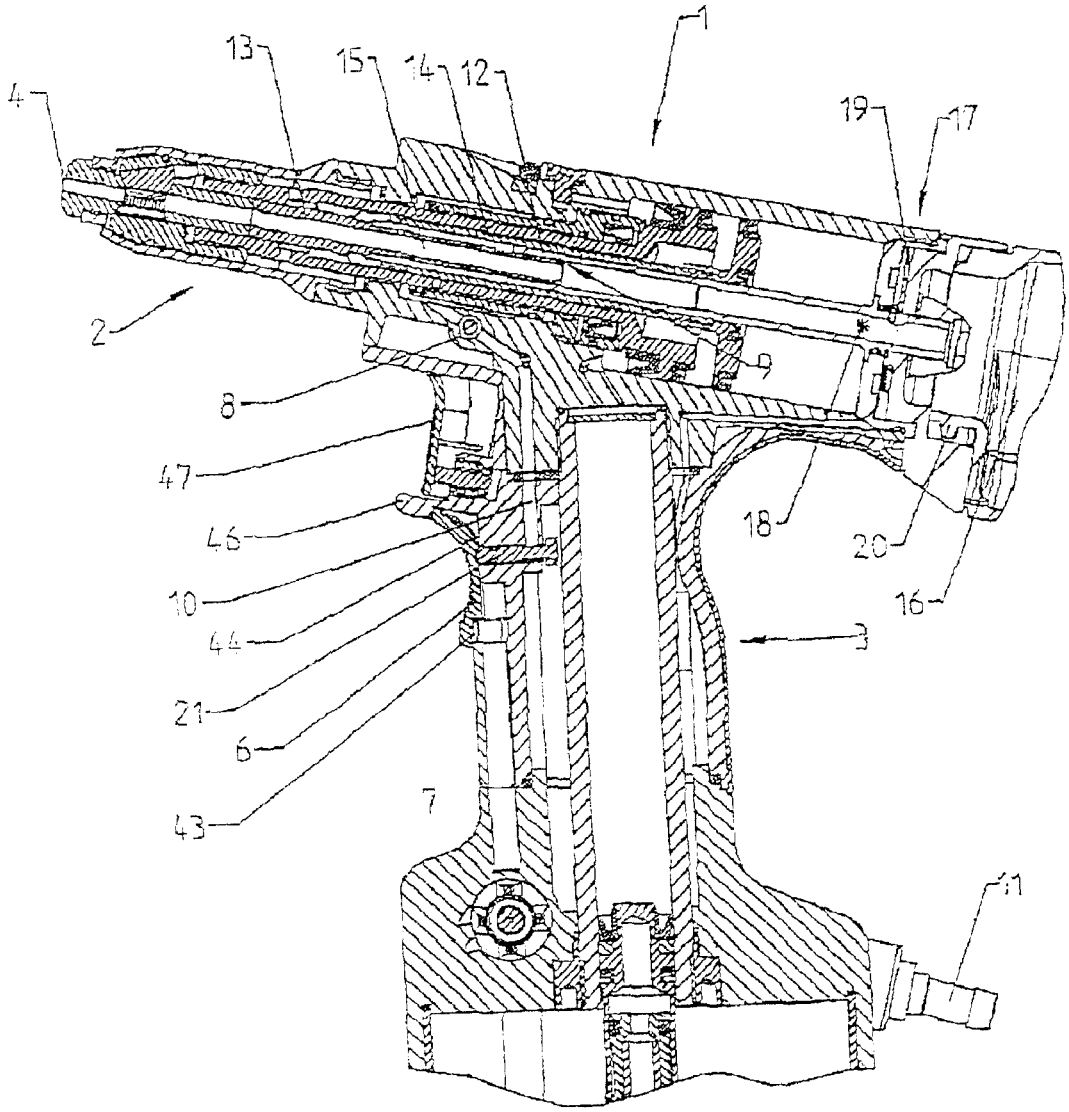
FIG. 2 is a schematic sectional view of a blind riveting device according to the present invention, wherein the suction device is activated.
Figure 3:
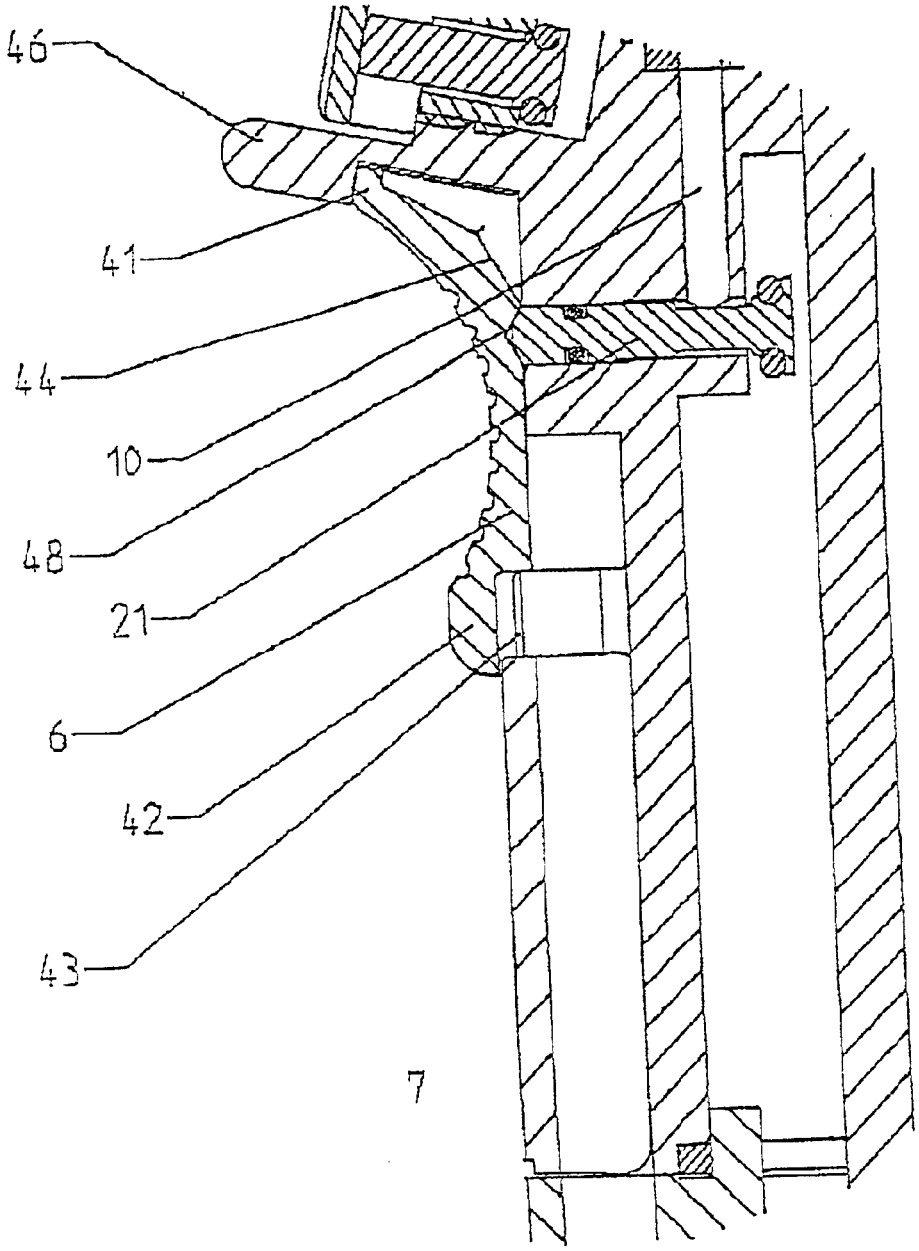
FIG. 3 shows a detail of FIG. 2 on a larger scale.

The handle 3 has at its front side 7 a slide 6 which can be moved from the illustrated position, which in the following will be called the switched-off position, into the direction of the head 2. Once the slide 6 has been moved up to its end position in the direction of the head 2, the slide 6 is in a position which in the following will be called the switched-on position. This position is shown in FIG. 2. The slide 6 is guided in the handle 3 in lateral guide means which are not illustrated in detail, so that the slide 6 can be moved upwardly and downwardly, but not out of the handle 3.

Arranged on the inner side of the slide 6 is a push rod 21 of a valve which controls the air supply to the nozzle 12. In the switched-off position of the slide 6 shown in FIG. 1, the air supply to the nozzle 12 is interrupted. In the switched-on position shown in FIG. 2, the air supply to the nozzle 12 is released. The valve with the push rod 21 is arranged in a duct which connects a compressed air connection 11 through a control member 8 to the suction device 9. The push rod 21 may be provided with a restoring spring, not shown. However, in many cases the air pressure from the compressed air connection 11 is sufficient for moving the push rod 21 once again back into its closed position when the slide 6 no longer holds the push rod 21 in the open position. Once the slide 6 has reached its switched-on position, the push rod 21 is engaged in the recess 48 provided on the inner side of the slide 6 as a result of the constant restoring force which permanently acts as a result of the air pressure in the direction of the slide 6. This actively locks the slide 6 in the switched-on position, even if the slide 6 is released by the operator. If the slide 6 is to be pushed back into the switched-off position, the push rod 21 must first be pressed inwardly through an inclined surface in the recess 48 until it slides over the corner 49. The slide 6 is now freely moveable.

The slide has at its upper end an inclined surface 44 which acts on the push rod 21. When the slide 6 is pushed as described, the push rod 21 is pushed into the handle 3 as a result of the downwardly directed force acting on the inclined surface 44.

The slide 6 has a recessed grip 40 which is constructed in such a way that middle finger of the hand of an operator or assembly worker comes to rest in the recessed grip 40 when he grasps the handle 3 of the blind riveting device 1. The slide 6 has at its upper end a protrusion 41 which makes it relatively easily possible to push the slide 6 into the switched-on position illustrated in FIG. 2. For this purpose, the operator can either push the slide 6 with the middle finger into the switched-on position, or the operator grasps the blind riveting device only with a loose grip. When the handle 3 is grasped, the index finger automatically comes into contact with a release element 47 and the middle finger comes into contact with the slide 6. When the operator lifts the blind riveting device which is being held with a loose grip and allows it intentionally to slide through the hand as a result of gravity, the middle finger will during this action displace the slide 6 upwardly to such an extent that the slide 6 comes into contact with the housing protrusion 46 in the recess 45. The housing protrusion 46 is located underneath the release element 47 which eventually is used for the placement procedure of the blind rivet. The release element 47 is constructed in the conventional manner as a pressure switch.

The slide 6 has at its upper end and on its inner side a switching surface 44 which acts during the displacement of the slide 6 on the push rod 21. When the slide 6 is displaced as described, the push rod 21 is pressed by means of an inclined plane into the handle 3 and opens the air supply in the duct 10. The release element 47 may be constructed as an actuating button.

An intentional action of the operator is also required for switching off the suction device 9. The operator must push the slide 6 once again into the switched-off position. This is facilitated by the recessed grip 40. Consequently, the operator only has to perform a small downward movement with his hand in order to push the slide 6 into the position illustrated in FIG. 1. Since the slide 6 protrudes by a small distance out of the handle 3, i.e., a small protrusion 42 is also provided at the lower end, the movement of the slide 6 through the hand of the operator does not pose difficulties.

The protrusion 42 is provided at an overlapping portion 43 along which the slide 6 covers the handle 3. In this manner, gaps or slots are prevented at the surface of the handle 3.

In the switched-on position illustrated in FIG. 2, the upper end of the slide 6 is received in a recess 45 provided in a housing protrusion 46 which is arranged below a release element 47 which eventually causes the placement procedure for a blind rivet to be actuated. The release element 47 is constructed in the conventional manner as a pressure switch.

The slide 6 has a length in the range of about 1.5 to 3 cm. This length is selected in such a way that the slide 6 can always only be actuated with one finger, preferably the middle finger, of a hand. This prevents uncontrolled movements of the slide 6 as a result of unintentional actuation by the other fingers.

A safety device 17 is additionally provided at the rearward end of the passage duct 15. This safety device 15 includes a disc 19 which can be partially pivoted into the cross-sectional area 18 of the duct 15.

For using the blind riveting device 1, the operator must pick up the blind riveting device 1 with his hand. He grasps the blind riveting device 1 at the handle 3. When the operator requires the suction device for holding the blind rivet in the blind riveting device 1 because riveting is to be carried out inclined downwardly or perpendicularly downwardly, the suction device is activated by either intentionally pushing the slide 6 upwardly to a stop in the direction of the head 2, or the operator lifts the blind riveting device 1 with a loose grip. This makes it possible for the operator to allow the blind riveting device 1 to slide downwardly as a result of gravity usually by a small distance and, as this occurs, to displace the slide 6 relative to the handle 3 because the middle finger rests against the protrusion 41 of the slide 6. The middle finger displaces the slide 6 until it comes into contact with the housing protrusion 46 in the recess 45. This causes the slide 6 to activate the suction device 9 by inwardly displacing the push rod 21. This movement of the push rod 21 opens the valve.

By opening the valve, the pressure duct 10 is released from the compressed air connection 11 to the suction device 9. Compressed air which flows between the pressure pipe 14 and the nozzle 12 is now admitted to the suction device 9. The nozzle effect produces a suction effect in the duct.

The operator can now insert the rivet bolt of a blind rivet into the opening 4. The suction effect causes the blind rivet to be held in this position, even if the housing head 2 is directed downwardly.

When the operator grasps the handle 3, for example, with a loose grip, or when he changes his grip of the handle 3, and the slide 6 is not touched, the action of the suction device 9 is still not interrupted because the slide 6 is secured in the switched-on position. Even when the operator releases the blind riveting tool 1 from his hand, for example, in order to align the components to be connected relative to each other, there is no danger that the blind rivet drops out of the opening 4.

On the other hand, if it is the intention of the operator to interrupt the assembly procedure and therefore no longer requires the suction device, he pushes the slide 6 downwardly to the stop by means of the middle finger in order to deactivate the suction device 9.

The pressure duct 10 can additionally be interrupted by means of a control member 8. When the operator does not require the suction device 9 because riveting is not to be carried out in an inclined or perpendicular downward direction, but horizontally or upwardly, he can switch off the suction function by means of the control member 8. For this purpose, the control member 8 is simply displaced and the duct 10 is closed. In this type of application, the slide 6 can be moved into the ergonomically favorable switched-on position and, thus, the push rod 21 can be pressed into the open position without causing air to flow through the duct 10 into the nozzle arrangement 9. Consequently, the slide 6 can always remain in the locked switched-on position and does not have to be actuated when the assembly procedure is interrupted. As soon as the operator once again wants to use the suction device, the suction device can be reactivated by switching it on by means of the control member 8. This once again releases the duct 10 and the suction device 9 can be switched on or off by displacing the slide 6. The torn off rivet bolts can be transported away by means of the air which previously served as the drive medium for the riveting procedure.

When the collecting container 16 is removed from the head 2, the safety device 17 is activated which interacts with the bayonet-type connection 20 of the collecting container 16.

When the collecting container 16 is put back on, the bayonet-type connection 20 displaces the disc 19 of the safety device 17 from an initial position and tensions a spring as a result. As soon as the collecting container 16 is removed, this spring is once again untensioned and the disc 19 returns into its initial position. In this initial position, the disc 19 blocks the cross-sectional area 18 of the duct 15 just to such an extent that a torn off rivet bolt of a blind rivet cannot be blown out toward the rear and, thus, any possible injuries are prevented. On the other hand, the compressed air can pass the safety device 17 to such an extent that no excess pressure can build up in front of the safety device 17. Consequently, the torn off rivet bolt cannot be blown out either at the rearward end or at the front end of the head 2.

While specific embodiments of the invention have been shown and described in detail to illustrate the inventive principles, it will be understood that the invention may be embodied otherwise without departing from such principles.

I claim:

1. A blind riveting device for placing blind rivets, the blind riveting device comprising: a device head having an opening in which a rivet bolt is receivable; a suction device arranged in the head for producing a negative pressure for holding the rivet bolt in the opening; a handle connected to the device head; and a control unit for switching the suction device on and off, the control unit including an actuating element arranged at the handle, and wherein the actuating element is formed and adapted to be lockable in a switched-on position.

2. The blind riveting device according to claim 1, wherein the actuating element is a slide.

3. The blind riveting device according to claim 2, wherein the control unit comprises a valve push rod, wherein the valve push rod engages in a recess on an inner side of the slide in a switched-on position.

4. The blind riveting device according to claim 2, wherein the slide is configured to be movable upwardly towards the device head for switching on the suction device.

5. The blind riveting device according to claim 2, wherein the slide has a protrusion at an end located in a switching-on direction.

6. The blind riveting device according to claim 5, wherein, in the switched-on position, the protrusion is received in a recess formed in a housing projection arranged underneath a release element.

7. The blind riveting device according to claim 2, wherein the slide protrudes from the handle.

8. The blind riveting device according to claim 2, wherein the slide comprises a recessed grip.

9. The blind riveting device according to claim 2, wherein the slide has a length of between 1.5 and 3 cm.

10. The blind riveting device according to claim 2, wherein the slide has an end directed towards a switched-off direction forming an overlapping portion with the handle.

11. The blind riveting device according to claim 3, wherein the slide comprises an active surface for actuating the valve push rod during displacement.

12. The blind riveting device according to claim 2, wherein the slide is arranged at a front side of the handle and is adapted to be actuated by the middle finger of an operator.

13. The blind riveting device according to claim 2, wherein the slide is arranged on a rear side of the handle and is adapted to be actuated by a ball of a finger or a saddle between a thumb and index finger of a hand.

14. The blind riveting device according to claim 1, further comprising a control member for interrupting an air supply to the suction device.

15. A blind riveting device for placing blind rivets, the blind riveting device comprising: a device head having an opening in which a rivet bolt is receivable; a suction device arranged in the head for producing a negative pressure for holding the rivet bolt in the opening; a handle connected to the device head; and a control unit for switching the suction device on and off, the control unit including an actuating element arranged at the handle, and wherein the actuating element is formed and adapted to be lockable in a switched-on position, the actuating element being a slide movable parallel to an outer surface of the handle.

16. A blind riveting device for placing blind rivets, the blind riveting device comprising: a device head having an opening in which a rivet bolt is receivable; a suction device arranged in the head for producing a negative pressure for holding the rivet bolt in the opening; a handle connected to the device head; and a control unit for switching the suction device on and off, the control unit including an actuating element arranged at the handle, and wherein the actuating element is formed and adapted to be lockable in a switched-on position, the actuating element being a slide configured to be movable upwardly towards the device head for switching on the suction device.

17. A blind riveting device for placing blind rivets, the blind riveting device comprising: a device head having an opening in which a rivet bolt is receivable; a suction device arranged in the head for producing a negative pressure for holding the rivet bolt in the opening; a handle connected to the device head; and a control unit for switching the suction device on and off, the control unit including an actuating element arranged at the handle, and wherein the actuating element is formed and adapted to be lockable in a switched-on position, the actuating element being a slide having a protrusion at an end located in a switching-on direction.

18. A blind riveting device for placing blind rivets, the blind riveting device comprising: a device head having an opening in which a rivet bolt is receivable; a suction device arranged in the head for producing a negative pressure for holding the rivet bolt in the opening; a handle connected to the device head; and a control unit for switching the suction device on and off, the control unit including an actuating element arranged at the handle, and wherein the actuating element is formed and adapted to be lockable in a switched-on position, the actuating element being a slide having a recessed grip.

19. A blind riveting device for placing blind rivets, the blind riveting device comprising: a device head having an opening in which a rivet bolt is receivable; a suction device arranged in the head for producing a negative pressure for holding the rivet bolt in the opening; a handle connected to the device head; and a control unit for switching the suction device on and off, the control unit including an actuating element arranged at the handle, and wherein the actuating element is formed and adapted to be lockable in a switched-on position, the actuating element being a slide having an end directed towards a switched-off direction forming an overlapping portion with the handle.

20. A blind riveting device for placing blind rivets, the blind riveting device comprising: a device head having an opening in which a rivet bolt is receivable; a suction device arranged in the head for producing a negative pressure for holding the rivet bolt in the opening; a handle connected to the device head; and a control unit for switching the suction device on and off, the control unit including an actuating element arranged at the handle, and wherein the actuating element is formed and adapted to be lockable in a switched-on position, the actuating element being a slide arranged on a rear side, of the handle and adapted to be actuated by a ball of a finger or a saddle between a thumb and index finger of a hand.

* * * * *